US007156246B2

(12) United States Patent
Sherrod

(10) Patent No.: US 7,156,246 B2
(45) Date of Patent: Jan. 2, 2007

(54) RETRACTABLE ROTATING ATV MOUNTED LIFT BOOM

(76) Inventor: Gregory F. Sherrod, 4915 Storymill Rd., Hephzibah, GA (US) 30815

( * ) Notice: Subject to any disclaimer, the term of this patent is extended or adjusted under 35 U.S.C. 154(b) by 202 days.

(21) Appl. No.: 10/940,975

(22) Filed: Sep. 15, 2004

(65) Prior Publication Data

US 2006/0054580 A1 Mar. 16, 2006

(51) Int. Cl.
*B66C 23/44* (2006.01)

(52) U.S. Cl. ..... 212/180; 414/462

(58) Field of Classification Search ..... 212/179, 212/180, 901; 414/462
See application file for complete search history.

(56) References Cited

U.S. PATENT DOCUMENTS

| | | | | |
|---|---|---|---|---|
| 981,561 | A * | 1/1911 | Hladky | 212/180 |
| 3,667,632 | A * | 6/1972 | Tidswell | 414/680 |
| 3,854,168 | A | 12/1974 | Bradley | 17/44.2 |
| 3,854,594 | A | 12/1974 | Brookes | 212/56 |
| 4,095,752 | A * | 6/1978 | Pomeret et al. | 414/744.2 |
| 4,419,038 | A | 12/1983 | Pendergraft | 414/543 |
| 4,806,063 | A | 2/1989 | York | 414/462 |
| 4,881,864 | A * | 11/1989 | Amato | 414/543 |
| 5,662,451 | A | 9/1997 | Muzzi et al. | 414/540 |
| 5,725,112 | A * | 3/1998 | Thorby | 212/180 |
| 5,975,831 | A * | 11/1999 | Martin | 414/543 |
| 6,089,431 | A * | 7/2000 | Heyworth | 224/521 |
| 6,109,855 | A | 8/2000 | Vela-Cuellar | 414/462 |
| 6,138,991 | A | 10/2000 | Myers, Jr. | 254/323 |
| 6,152,675 | A | 11/2000 | Compton | 414/543 |
| 6,155,771 | A | 12/2000 | Montz | 414/543 |
| 6,202,868 | B1 | 3/2001 | Murray | 212/294 |
| 6,250,483 | B1 | 6/2001 | Frommer | 212/180 |
| 6,530,738 | B1 * | 3/2003 | Maxwell | 414/462 |
| 6,578,722 | B1 | 6/2003 | Perkins et al. | 212/180 |
| 6,599,078 | B1 * | 7/2003 | Elder | 414/542 |
| 6,830,423 | B1 * | 12/2004 | Williams et al. | 414/462 |
| 6,921,007 | B1 * | 7/2005 | Guerrant | 224/519 |
| 2002/0168258 | A1 | 11/2002 | Philipps et al. | 414/462 |
| 2002/0173262 | A1 | 11/2002 | Stiefel | 452/185 |

FOREIGN PATENT DOCUMENTS

| | | |
|---|---|---|
| CA | 1 156 614 | 11/1983 |
| EP | 0 425 733 | 10/1989 |

OTHER PUBLICATIONS

Internet Web Site, filed Nov. 2003, Cabela's Game Hitch.

* cited by examiner

*Primary Examiner*—Thomas J Brahan
(74) *Attorney, Agent, or Firm*—Richard C. Litman

(57) ABSTRACT

A retractable rotating ATV mounted lift boom for an ATV rack used to lift various objects. The invention includes a horizontal base plate and angle iron attached to the ATV rack, a horizontal female receiving tube attached onto the horizontal base plate, a horizontal elongated male piece that can be inserted and removed from the horizontal female receiving tube and a rotatable vertical elongated base piece that is perpendicularly attached to the horizontal elongated male piece. There is also a first elongated piece that is pivotally attached to the vertical elongated base piece, a second elongated piece that is pivotally attached to the first elongated piece and a third elongated piece pivotally attached to the second elongated piece.

5 Claims, 4 Drawing Sheets

RETRACTABLE ROTATING ATV MOUNTED LIFT BOOM

BACKGROUND OF THE INVENTION

1. Field of the Invention

The present invention relates to a retractable rotating ATV mounted lift boom.

2. Description of the Related Art

ATVs or all terrain vehicles are very useful in getting to remote and rough terrain locations that are frequently hunted and cannot be accessed by a pick-up truck. The ATVs are particularly important because they can be equipped with a lift or hoist that can be used to skin and dress captured game right on sight or to carry and lift cargo or heavy equipment. These lifts and hoists are particularly useful when hanging and dressing game, since the hunter using the ATV does not have to drag the captured game on the ground, which expends a lot of energy and prevents contamination or damage of the captured game.

It is known to equip ATVs and pick-up trucks with lifting devices that can hoist a captured game upwards and allow a hunter to hoist the captured game and skin and dress it right at the point of kill. By skinning and dressing the captured game early after the captured game has been killed, the hunter can better prepare the meat from the captured game. These lifting devices can be collapsible for easy storage and will often include a winch and a gambrel. Other features include supporting brackets to the ground or fender of a vehicle and a spindle to turn or spin the captured game into different positions in relation to the transporting vehicle.

There are also such lifting devices designed specifically for ATVs. The ATVs and lifting devices are many times preferred by hunters over pick-up trucks because of their mobility and are known to have accessory features such as a spindle to rotate any hanging captured game, a winch and gambrel and a lifting device that has a telescoping boom. Although the lifting devices for ATVs are novel and useful, they could be improved. If these lifting devices include features such as being retractable and having a quick receiver type hitch, they could be even more convenient and easy to use and would probably be well-received in the marketplace.

None of the above inventions and patents, taken either singly or in combination, is seen to describe the instant invention as claimed. Thus a retractable rotating ATV mounted lift boom solving the aforementioned problems is desired.

SUMMARY OF THE INVENTION

The invention is a retractable rotating ATV mounted lift boom for an ATV rack used to lift various objects. The invention includes a horizontal base plate and angle iron attached to the ATV rack, a horizontal female receiving tube attached onto the horizontal base plate, a horizontal elongated male piece that can be inserted and removed from the horizontal female receiving tube and a rotatable vertical elongated base piece that is perpendicularly attached to the horizontal elongated male piece. There is also a first elongated piece that is pivotally attached to the vertical elongated base piece, a second elongated piece that is pivotally attached to the first elongated piece and a third elongated piece pivotally attached to the second elongated piece.

It is an object of the invention to provide improved elements and arrangements thereof for the purposes described which is inexpensive, dependable and fully effective in accomplishing their intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
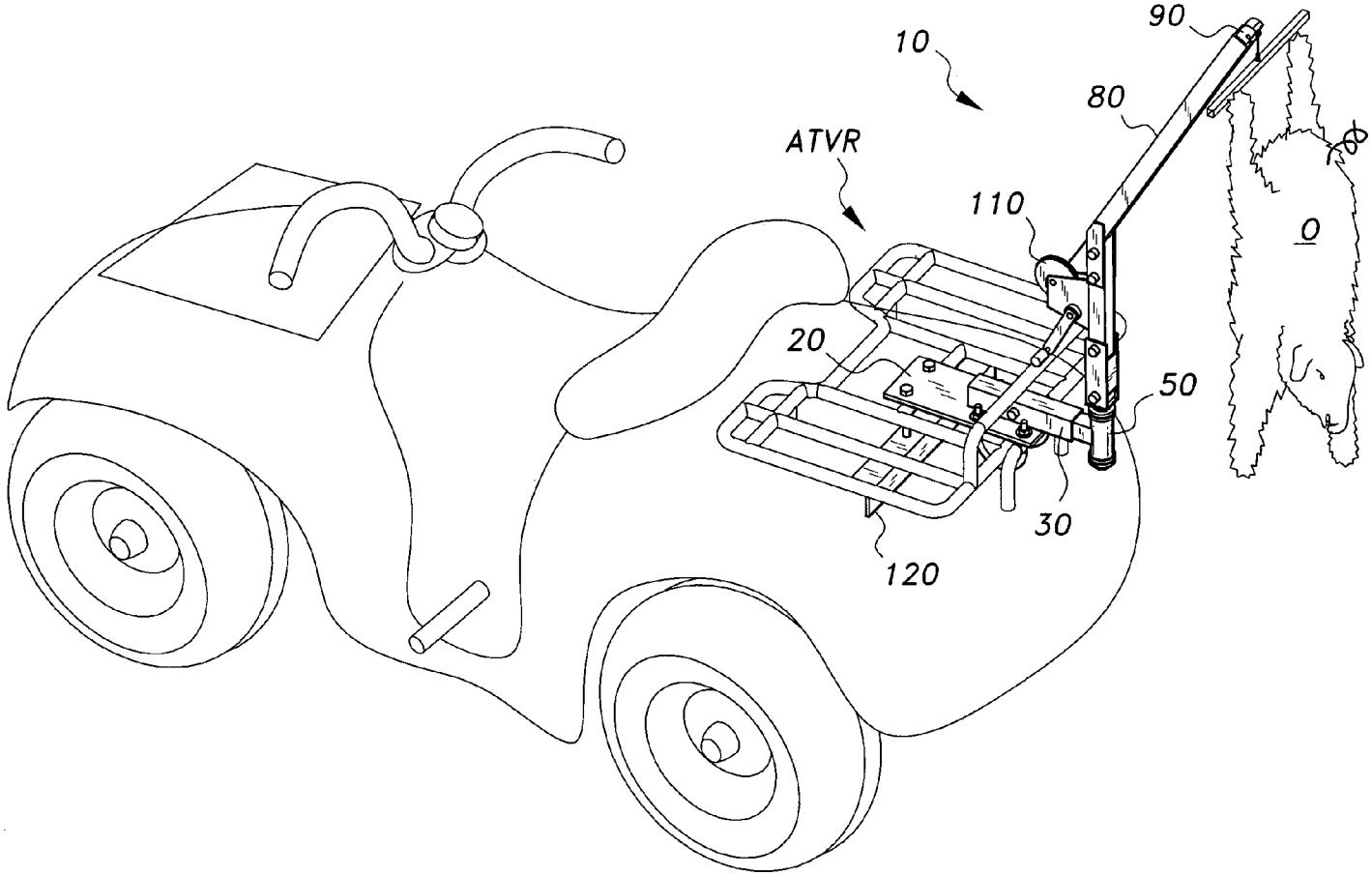
FIG. 1 is an environmental, perspective view of a retractable rotating ATV mounted lift boom according to the present invention.

The present invention is a retractable rotating ATV mounted lift boom 10 for an ATV rack ATVR used to lift an object(s) O, as is shown in FIG. 1.

The retractable rotating ATV mounted lift boom 10 comprises a horizontal base plate 20 attached to the ATV rack ATVR, a horizontal female receiving tube 30 attached onto the horizontal base plate 20, a horizontal elongated male piece 40 with a distal end 42 and a proximal end 44, that can be inserted and removed from the horizontal female receiving tube 30, a rotatable vertical elongated base piece 50 that is perpendicularly attached to the proximal end of the horizontal elongated male piece 44, a first elongated piece 60 with a proximal end 62 and a distal end 64 that is pivotally attached to the rotatable vertical elongated base piece 50 at the proximal end of the first elongated piece 62 and a second elongated piece 70 with a proximal end 72 and a distal end 74 that is pivotally attached to the first elongated piece 60 at the proximal end of the second elongated piece 72.

Figure 2:
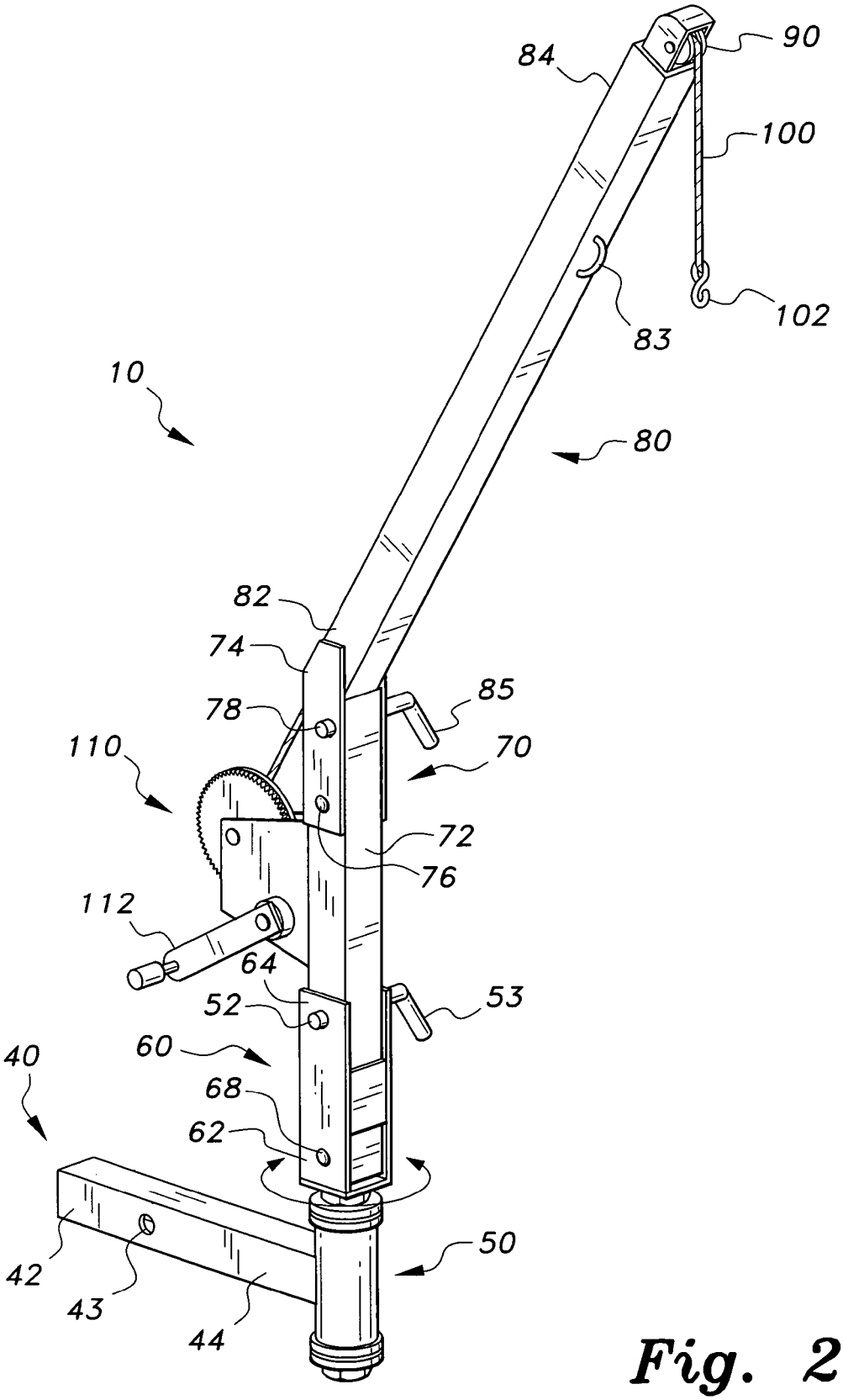
FIG. 2 is a side perspective view of the retractable rotating ATV mounted lift boom in a working position.
Figure 3:
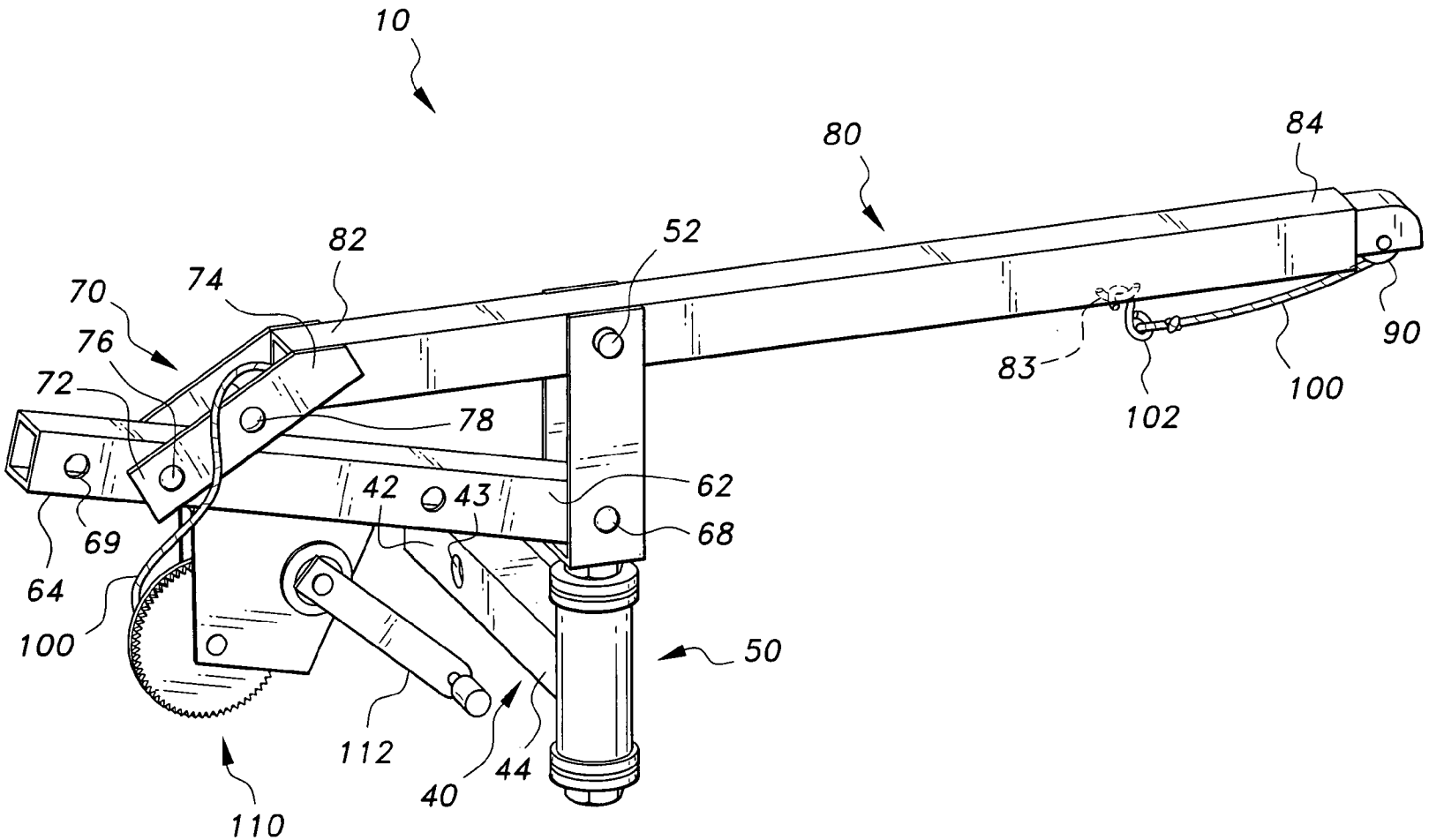
FIG. 3 is a side perspective view of the retractable rotating ATV mounted lift boom in a retracted position.

The retractable rotating ATV mounted lift boom 10 further comprises a third elongated piece 80 with a proximal end 82 and a distal end 84 that is pivotally attached to the second elongated piece 70 at the proximal end of the third elongated piece 82, a guiding rotating wheel 90 at the distal end of the third elongated piece 84, a lifting line 100 used to lift the object(s) O, a manual winch 110 that is used to provide power to the lifting line 100 to lift the object(s) O and a winch handle 112 that is provided on the manual winch 110 to facilitate use of the manual winch 110. These features of the retractable rotating ATV mounted lift boom 10 are illustrated in FIG. 2 and FIG. 3.

Figure 4:
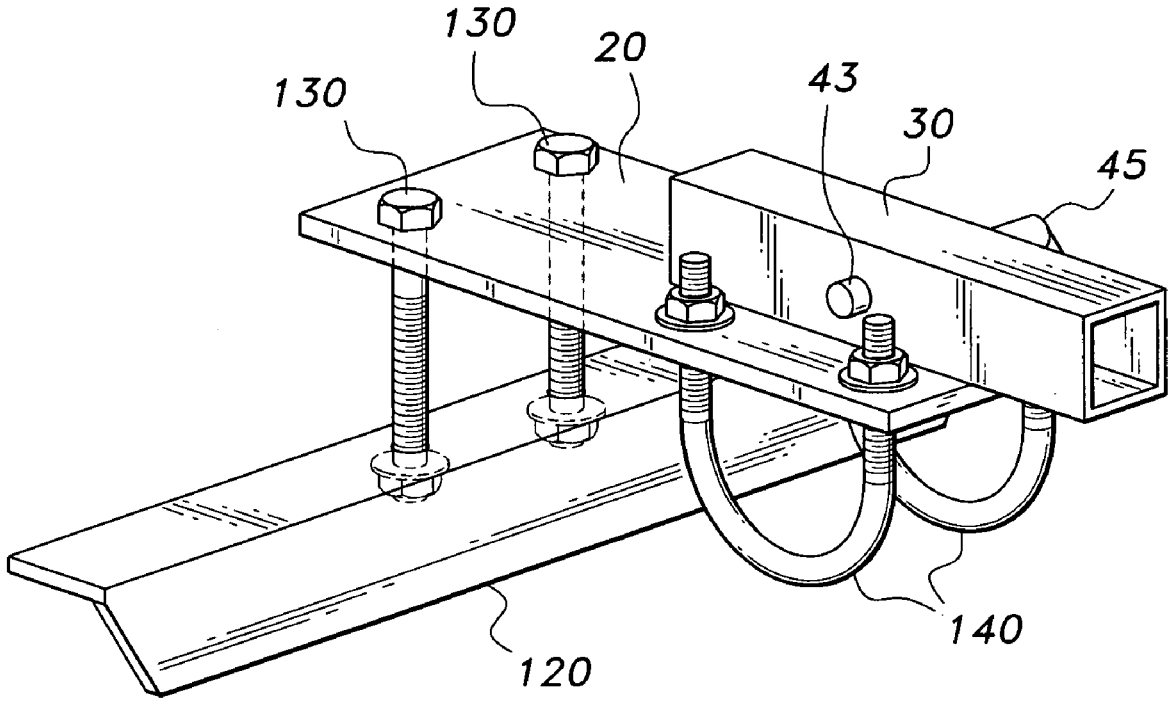
FIG. 4 is a side perspective view of the base and female receiver of the retractable rotating mounted lift boom.

There is also angle iron 120 used with the horizontal base plate 20 to secure the retractable rotating ATV mounted lift boom 10. The ATV rack ATVR is sandwiched between the angle iron 120 and the horizontal base plate 20 and is secured with nuts, bolts and washers 130 and u-bolts 140, as is depicted in FIG. 4. The horizontal female receiving tube 30 is permanently attached to the horizontal base plate 20 by welding or other means for attaching that is known in the related art. The aperture on the horizontal female receiving tube 32 and the aperture on the horizontal elongated male piece 43 correspond with each other to form a single aperture (not shown) that can be inserted with a first hitch pin 45 to secure the horizontal female receiving tube 30 and the horizontal elongated male piece 40. Of course the first hitch pin 45 can also be removed to separate the horizontal female receiving tube 30 and the horizontal elongated male piece 40.

The horizontal female receiving tube 30, the horizontal elongated male piece 40, the rotatable vertical elongated base piece 50, the first elongated piece 60, the second elongated piece 70 and the third elongated piece 80 can be made of square tubing or circular tubing. The retractable rotating ATV mounted lift boom 10 has a manual winch 110 but can also utilize an electric powered winch (not shown) as well. The end of the lifting line 100 can be provided with an eye-hook 102 or a gambrel (not shown) to lift various objects O such as hunted game animals, a piece(s) of heavy equipment and cargo. There is also an eyelet 83 near the distal end of the third elongated piece 84 that can be used to hold an eye-hook 102 or other type of hook to prevent the eye-hook 102 from swaying or hanging loose.

Use of the retractable rotating ATV mounted lift boom 10 is uncomplicated. Welds that allow the retractable rotating ATV mounted lift boom 10 to retract and move are located at the proximal end of the first elongated piece 68 and the proximal end of the second elongated piece 76. The retractable rotating ATV mounted lift boom 10 can be placed in a retracted position for easy and convenient storage, as is shown in FIG. 3. The retractable rotating ATV mounted lift boom 10 can also be locked into a working position as is shown in FIG. 2. An aperture located on the distal end of the rotatable vertical elongated base piece 52 can be lined up with another aperture located on the middle portion of the first elongated piece 66. This can be done by aligning the first elongated piece 60 vertically with the rotatable vertical elongated base piece 50. Once aligned, a second hitch pin 53 can be placed in and through the aligned apertures 52,66 thereby locking the bottom part of the retractable rotating ATV mounted lift boom 10 in place.

An additional set of apertures can also be aligned on the top portion of the retractable rotating ATV mounted lift boom 10 as well. An aperture located on the distal end of the first elongated piece 69 can also be aligned with an aperture located on the middle of the second elongated piece 78. Note that these apertures 69,78 can also be aligned into a single aperture by moving the second elongated piece 70 in alignment with the stationary first elongated piece 60. Once these two apertures 69,78 are aligned, a third hitch pin 85 can be put into and through these two apertures 69,78 thereby securing the remainder of the retractable rotating ATV mounted lift boom 10. All three of the hitch pins 45,53,85 can be manually inserted and removed by a user for assembling or breaking down the retractable rotating ATV mounted lift boom 10.

It is to be understood that the present invention is not limited to the embodiments described above, but encompasses any and all embodiments within the scope of the following claims.

I claim:

1. A retractable rotating ATV mounted lift boom for an ATV rack used to lift an object(s), comprising:

a horizontal base plate and angle iron;

means for attaching said base plate and said angle iron to an ATV rack;

a horizontal elongated female receiving tube attached onto the horizontal base plate;

a horizontal elongated male piece with a distal end and a proximal end, said distal end being removably secured to the horizontal female receiving tube;

a rotatable vertical elongated base piece perpendicularly attached to the proximal end of the horizontal elongated male piece and being spaced from the horizontal base plate along the longitudinal axis of the horizontal elongated receiving tube;

a first elongated piece with a proximal end and a distal end that is pivotally attached to the vertical elongated base piece at the proximal end of the first elongated piece;

a second elongated piece with a proximal end and a distal end that is pivotally attached to the first elongated piece at the proximal end of the second elongated piece;

a third elongated piece with a proximal end and a distal end that is pivotally attached to the second elongated piece at the proximal end of the third elongated piece;

a guiding rotating wheel at the distal end of the third elongated piece;

a lifting line with a loose end adapted to lift the object(s);

a hook that is located on the loose end of the lifting line adapted to secure the object(s);

an eyelet that is adapted to hold the hook while the hook is not in use;

a winch that is used to provide power to the lifting line to lift the object(s); and a winch handle that is provided on the winch to facilitate use of the winch.

2. The lift boom according to claim 1, wherein the horizontal female receiving tube is welded to the horizontal base plate.

3. The lift boom according to claim 1, wherein the horizontal elongated male piece is secured within the horizontal female receiving tube with a hitch pin inserted in corresponding apertures on the horizontal elongated male piece and the horizontal female receiving tube.

4. The lift boom according to claim 1, wherein the horizontal female receiving tube, the horizontal elongated male piece, the rotatable vertical elongated base piece, the first elongated piece, the second elongated piece and the third elongated piece are made of square tubing.

5. The lift boom according to claim 1, wherein the horizontal female receiving tube, the horizontal elongated male piece, the rotatable vertical elongated base piece, the first elongated piece, the second elongated piece and the third elongated piece are made of circular tubing.

* * * * *